US005901655A

United States Patent [19]

Sadasue

[11] Patent Number: 5,901,655

[45] Date of Patent: May 11, 1999

[54] MULTI-THREAD CHAIN SWITCH SEWING MACHINE

[75] Inventor: Kazuya Sadasue, Tokyo, Japan

[73] Assignee: Juki Corporation, Tokyo, Japan

[21] Appl. No.: 08/927,383

[22] Filed: Sep. 12, 1997

[30] Foreign Application Priority Data

Sep. 12, 1996 [JP] Japan ..... 8-263483

[51] Int. Cl.[6] ..... D05B 1/20; D05B 61/00

[52] U.S. Cl. ..... 112/162; 112/165

[58] Field of Search ..... 112/168, 165, 112/162, 166, 199, 177, 475.26

[56] References Cited

U.S. PATENT DOCUMENTS 5,467,725 11/1995 Fujita et al. ..... 112/162

5,517,933 5/1996 Karaba, Jr. ..... 112/166 X 5,697,310 12/1997 Shirakura et al. ..... 112/168

*Primary Examiner*—Peter Nerbun

*Attorney, Agent, or Firm*—Morgan & Finnegan, LLP

[57] ABSTRACT

An upper decorative stitching spreader 11 is switched active or inactive by an upper decoration switching mechanism 25. By placing the spreader 11 in active state, upper decorative stitches which are formed from above the fabric are added to the conventional over-edge chain stitches and lower decorative stitches which are formed from below the fabric. On the other hand, by placing the spreader 11 in an inactive state; that is, by stopping the spreader 11, over-edge chain stitching without upper decorative stitching, and lower decorative stitching which is performed from below the fabric are performed without interference with the spreader 11.

4 Claims, 9 Drawing Sheets

(a)

(b)

(c)

MULTI-THREAD CHAIN SWITCH SEWING MACHINE

BACKGROUND OF THE INVENTION

This invention relates to a multi-thread chain stitch sewing machine in which a spreader mechanism used to form upper decorative stitches is switched active and inactive, and to an over-edge chain stitch sewing machine in which a selecting operation is carried out so that upper decorative stitching is performed or not.

In general, an over lock sewing machine has upper and lower loopers, to perform over-edge chain stitching. Recently, as disclosed by Japanese Patent Application Laid-open No. 6-262 (corresponding to U.S. Pat. No. 5,255,622), an over look sewing mechanism has been known which has a mechanism for switching over operating and no-operating the upper looper so that either the over-edge chain stitch or the multi-thread chain stitch can be formed.

Alternately, as disclosed by Japanese Patent Application Laid-open No. Hei. 7-68072 filed by the present Applicant an over lock sewing machine has been known which has a mechanism for holding the upper looper, and a loop spreading mechanism with respect to the lower looper, so that over-edge chain stitching and lower decorative stitching (covering chain stitching) can be selectively performed.

In addition, as for an industrial sewing machine, an upper decorative stitch sewing machine is also known in the art which has a spreader to form upper decorative stitches only.

In the above-described lower decorative stitching operation, decorative stitches are formed on the lower surface of a fabric which confronts with the throat plate, and the feeding teeth of the sewing machine are protruded from the upper surface of the throat plate to feed the fabric. Hence, the lower surface of the fabric is rubbed by the feeding teeth, thus being damaged. Therefore, generally the fabric is placed over the throat plate in such a manner that the wrong side (back) of the fabric confronts with the throat plate accordingly with the feeding teeth. Hence, the lower decorative stitches are formed on the wrong side (back) of the fabric. And the wrong side of the fabric on which the decorative stitches have been formed must be set outside when for instance clothes are formed with the fabric. Hence, the resultant clothes are low in quality.

In the case of sewing a cloth material for which, as in the case of attaching rubber tape or lace to underwear, it is necessary to perform decorative stitching on both surfaces thereof (i.e., it is necessary to perform decorative stitching on each of the two surfaces), which makes it rather troublesome to perform the sewing operation.

SUMMARY OF THE INVENTION

According to a first aspect of the present invention, there is provided a multi-thread chain stitch sewing machine in which at least a lower looper cooperates with sewing needles fixed to a needle bar to form multi-thread chain stitch seams, comprising: a spreader having a vertical axis about which the spreader reciprocates to move to and from the needle bar, for twisting an upper thread from the upper surface of a seam to add upper decorative stitches to an ordinary seam; a drive mechanism which applies a drive force being synchronous with the needle bar, to the spreader; and a switching mechanism which connects the spreader to the drive mechanism and disconnects the spreader from the drive mechanism.

According to a second aspect of the present invention, there is provided an over-edge chain stitch sewing machine in which at least an upper looper is selectively placed in active state or in inactive state, so that an over-edge chain stitch seam which is formed with the upper looper and a lower looper, and a multi-thread chain stitch seam which is formed with the lower looper only are selectively formed, the over-edge chain stitch sewing machine comprising a spreader having a vertical axis about which the spreader reciprocates to move to and from the needle bar, for twisting an upper thread from the upper surface of a seam to add upper decorative stitches to an ordinary seam; a drive mechanism which applies a drive force being synchronous with the needle bar, to the spreader; and a switching mechanism which connects the spreader to the drive mechanism and disconnects the spreader from the drive mechanism.

DETAILED DESCRIPTION OF THE PREFERRED EMBODIMENTS

An over lock sewing machine, an embodiment of the invention, will be described with reference to the accompanying drawings.

Figure 9:
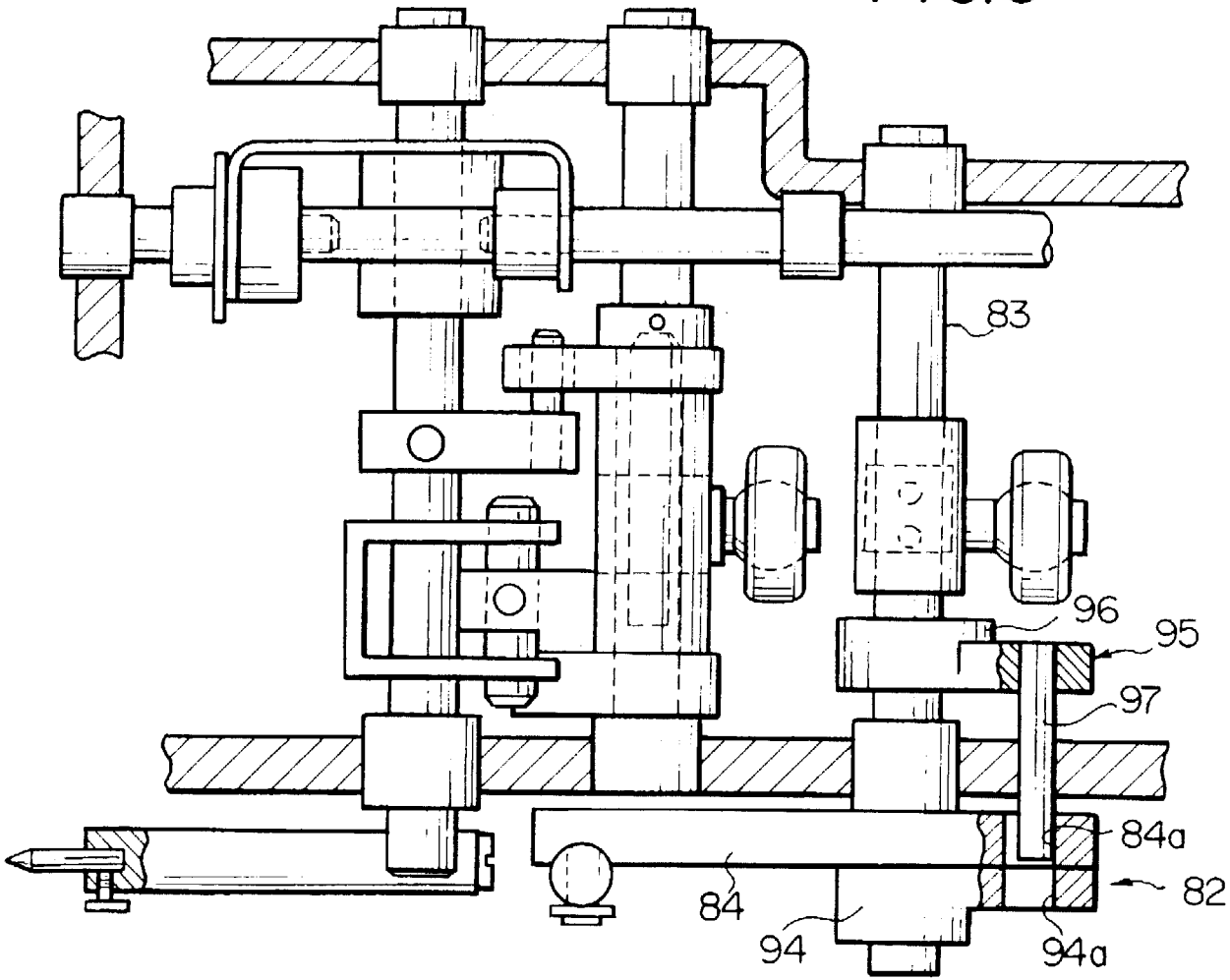
FIG. 9 is an explanatory diagram for a description of an upper looper stopping mechanism.

The sewing machine of the invention has an upper looper stopping mechanism as disclosed by the aforementioned Japanese Patent Application Laid-open No. Hei. 6-262 (U.S. Pat. No. 5,255,622), and as shown in FIG. 9, an oscillating/release mechanism 82 operates to transmit or not to transmit oscillational motion of the lower looper shaft to the upper looper oscillating arm 84. In the illustrated embodiment, the mechanism 82 includes an upper looper oscillation connecting arm 94 secured to the lower looper shaft 83, and a means 95 for engaging or disengaging the upper looper oscillating arm 84 with the upper looper oscillation connecting arm 94. The release means 95 includes an upper looper release body 96 and an upper looper release pin 97 secured to the upper looper release body 96. The upper looper release body 96 is attached to the upper looper shaft 83 so that it may be slidable along the longitudinal axis of the shaft 83. The upper looper release pin 97 is designed so as to be smoothly received in notches 84*a* and 94*a* formed in the upper looper oscillating arm 84 and upper looper oscillation connecting arm 94, respectively. The upper looper release body 96 is displaced by means of the motion change-over device between an oscillational position in which the upper looper release pin 97 is engaged with the upper looper oscillation connecting arm 94 and a non-oscillational position in which the pin 97 is not engaged with the arm 94, the operation of the motion change-over device. More particularly, the upper looper release pin 97, in the oscillational position, is engaged with the upper looper oscillation connecting arm 94 and upper looper oscillating arm 84, so that oscillational motion of the upper looper shaft 83 may be transmitted to the upper looper oscillating arm 84 through the upper looper oscillation connecting arm 94, whereby the upper looper will be oscillated. On the other hand, the upper looper release pin 97, in the non-oscillational position, is not engaged with the upper looper oscillation connecting arm 94, so that oscillational motion of the upper looper 83 is not transmitted to the upper looper oscillating arm 84. It is noted that, in the non-oscillational position, the upper looper shift 83 is positioned in the lowermost position.

Figure 10:
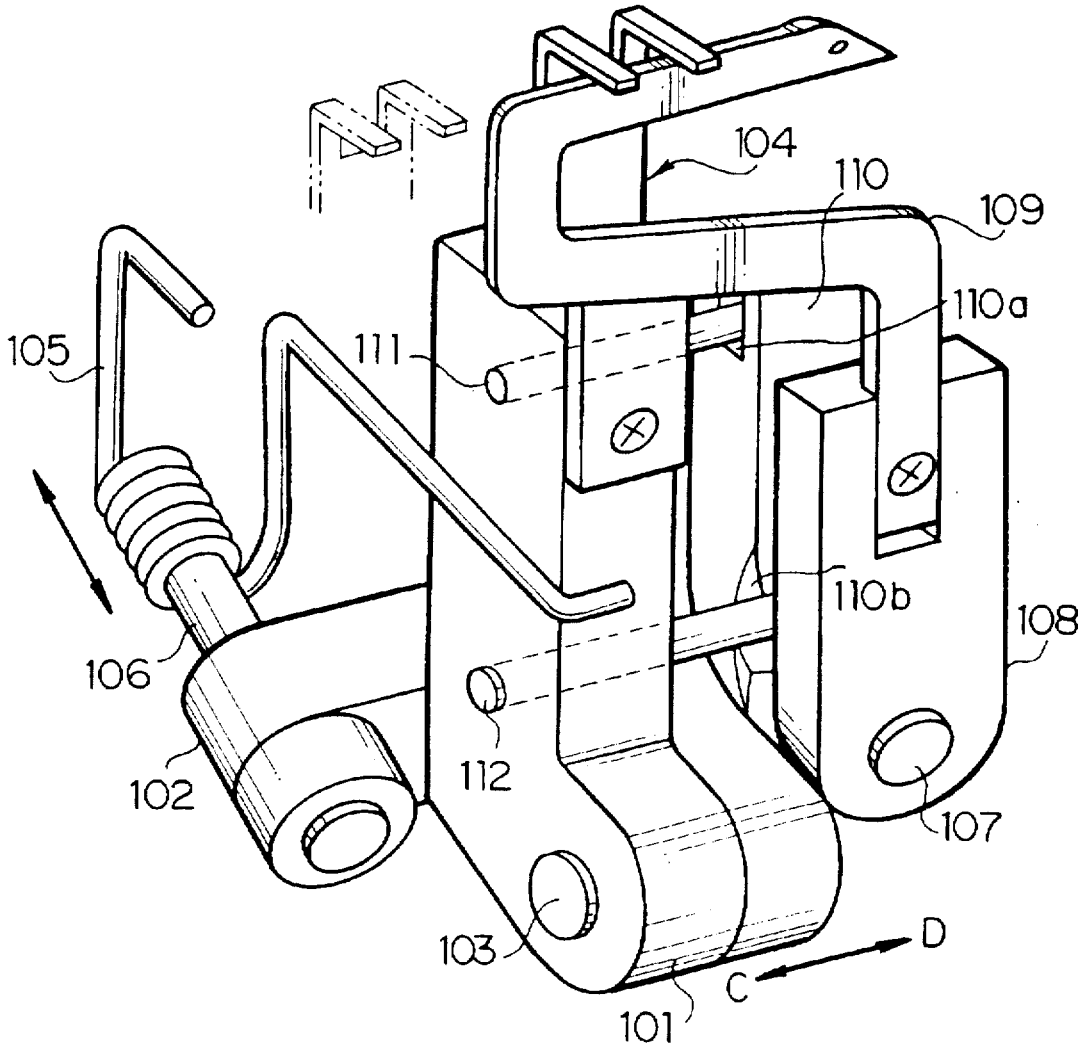
FIG. 10 is an explanatory diagram for a description of a loop spreading mechanism.

Furthermore, the sewing machine has a loop spreading mechanism disclosed by Japanese Patent Application Laid-open No. Hei. 7-68072 (U.S. Pat. No. 5,467,725). That is, as shown in FIG. 10, a hook oscillating arm 101 is rotatably attached to the support member 102 through an auxiliary oscillating pin 103. The auxiliary oscillating pin 103 extends laterally of the machine (i.e., in the direction CD as viewed in the figure).

A thread spreading hook or positioning member 104 is screwed to the hook oscillating arm support member 101. The thread spreading hook or positioning member 104 is longitudinally pivotable relative to the base, and needle plate about the auxiliary oscillating pin 103, together with the hook oscillating arm 101 as one unit. In an operative state, the thread spreading hook 104 lies in the position shown by the solid line in the figure, whereas, in an in operative state, it lies in the position shown by the two-dot and dash line.

A torsion spring 105 is attached to the hook rotating shaft 106. The torsion spring 105 has one working end retained by the machine frame and the other end abutting against the hook oscillating arm 101, thereby constantly biasing the hook oscillating arm 101 rightwardly.

A lower looper shaft 107 extends longitudinally of the machine. When a main shaft (not shown) rotates, the lower looper shaft 107 is caused to oscillate laterally through a looper cam, a looper rod, etc. (which are not shown) by using the main shaft as a drive source, and it is also allowed to moved longitudinally through a multi-thread chain stitching cam, a longitudinal oscillating shaft, etc. (which are not shown) It should be noted that when over-edge chain stitching is to be performed, the main shaft and the lower looper shaft 107 are disconnected from each other by the change-over device (not shown) so that the lower looper shaft 107 will not perform longitudinal reciprocating motion, and at this time, the thread spreading hook 104 performs only the lateral pivotal motion at the position shown by the two-dot and dash line in the figure.

A lower looper support arm 108 is secured to the lower looper shaft 107. The lower looper 109 is screwed to the lower looper support arm 108.

In addition, a hook oscillating collar (oscillation transmitting arm) 110 is secured to the lower looper shaft 107. The hook oscillating collar 110 has a bifurcated portion 110*a* at the top thereof and a cam portion 110*b* at the bottom thereof.

One end of a longitudinal oscillation transmitting pin 111 and one of a lateral oscillation transmitting pin 112 are secured to the hook oscillating arm 101. The other end of the longitudinal oscillation transmitting pin 111 is fitted in the bifurcated portion 110*a* of the hook oscillating collar 110. The other end of the lateral oscillation transmitting pin 112 is in contact with the cam portion 110*b* of the hook oscillating collar 110.

Figure 8:
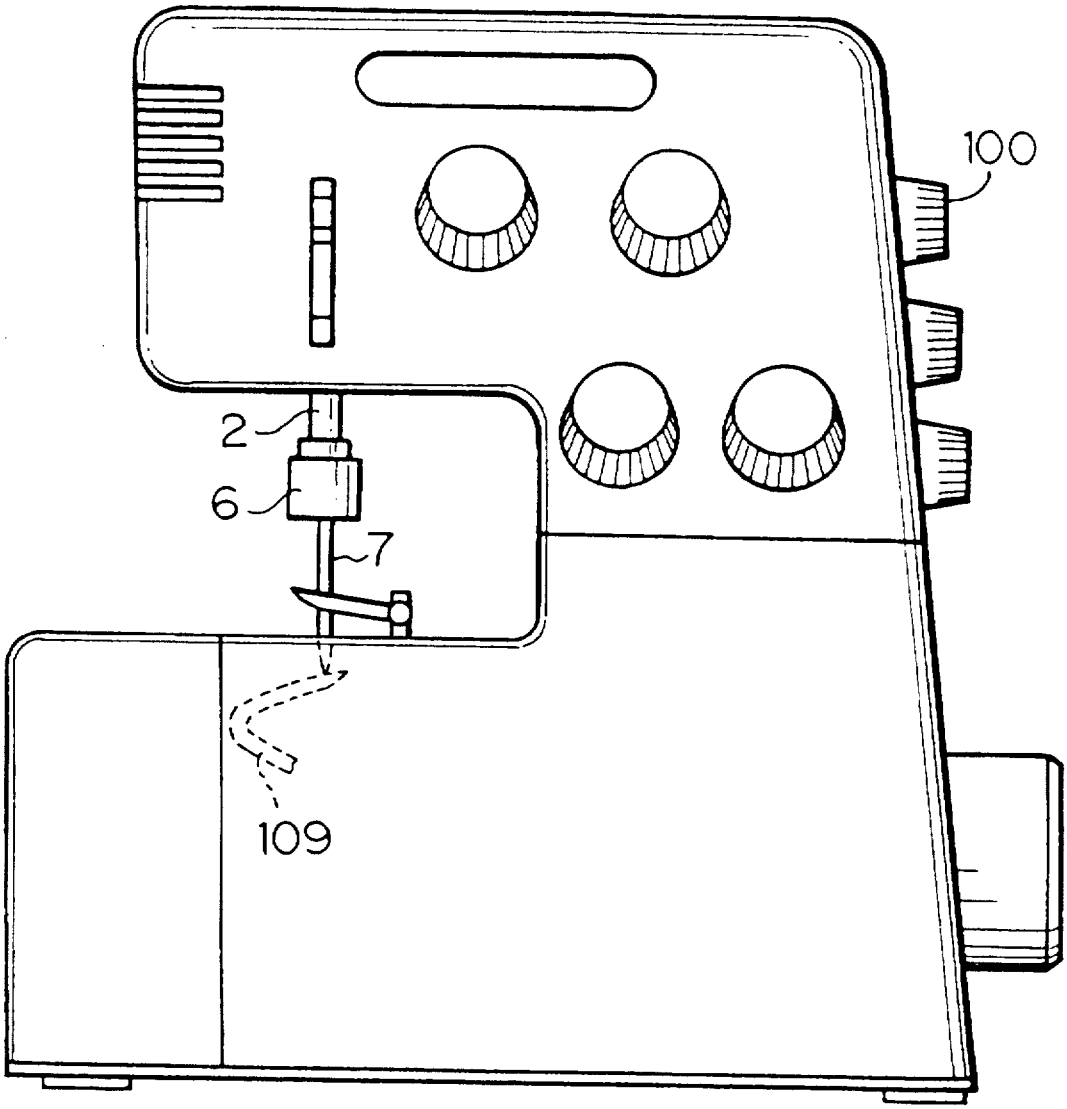
FIG. 8 is a front view of a conventional over lock sewing machine.

These mechanisms are arranged in a sewing machine, as illustrated in FIG. 8, and the type of seam is set by a seam selecting device 100. FIG. 8 illustrates the relationship of the lower looper 109 to the sewing machine needle 7, which is held by needle holder 6 and needle bar 2.

Figure 1:
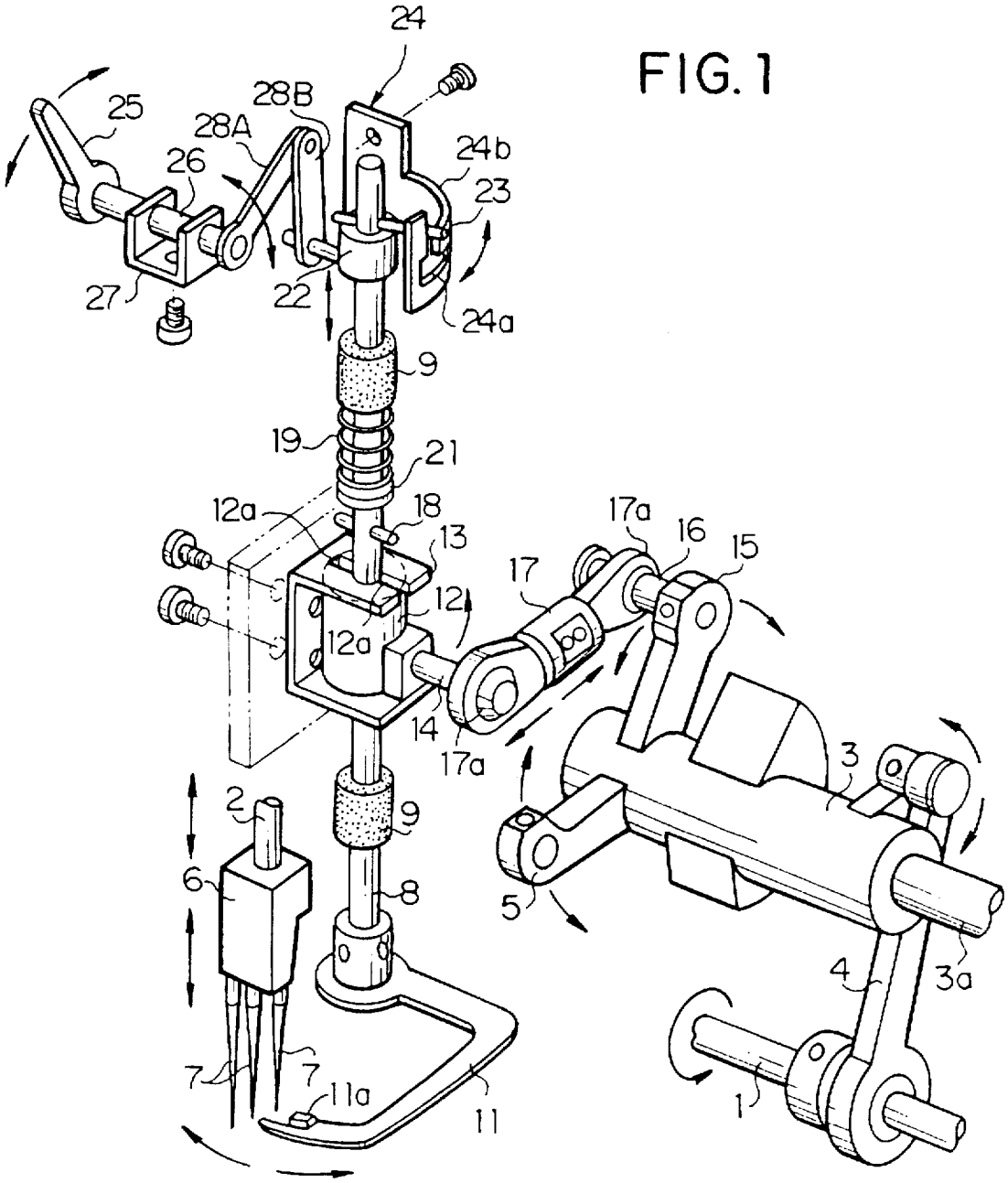
FIG. 1 is a perspective view showing essential components of the upper decorative sewing mechanism of a sewing machine, which constitutes an embodiment of the invention.

In an over lock sewing machine shown in FIG. 1, its needle bar 2 is so provided that it is moved up and down by the rotational drive force of a spindle 1 with predetermined timing. A needle bar drive crank 3, which is provided above the spindle 1 in such a manner that it is in parallel with the spindle, is coupled through a needle bar crank rod 4 to the spindle 1, and it is reciprocated in a predetermined angular range as the spindle 1 is turned. The needle bar crank 3 is turned about a needle bar drive shaft 3*a*.

The end portion (on the swing side) of a needle bar drive arm 5, which is extended radially outwardly from the needle bar drive crank 3, is coupled through a swing drive force transmitting mechanism (not shown) to the needle bar 2, so that, as the needle bar drive crank 3 is reciprocated, the needle bar 2 is moved up and down. Three sewing needles 7, 7 and 7 are detachably coupled through a needle holder 6 to the lower end of the needle bar 2 in such a manner that they are parallel and arranged in a line which is substantially perpendicular to a fabric feeding direction. In the case of an over lock sewing operation, the arrangement and the number of the needles 7 are different from those described above.

A spreader shaft 8 vertically extends in such a manner that it is adjacent to one side of the needle bar 2. The spreader shaft 8 is supported by a pair of bearings 9 and 9 secured to a machine frame (not shown) in such a manner the spreader shaft 8 is vertically slidable, and rotatable. The lower end of the spreader shaft 8 is secured to the base of a curved-plate-shaped spreader 11.

The spreader 11 extends from the spreader shaft 8 towards the needle bar 2 in a substantially horizontal plane. The spreader is moved to and from the needles 7 with the upper thread caught by a thread guide 11*a* provided at the end of the spreader 11, so that the upper thread is twisted around an ordinary over-edge chain stitches and lower decorative stitches from above, to add upper decorative stitches thereto.

Figure 2:
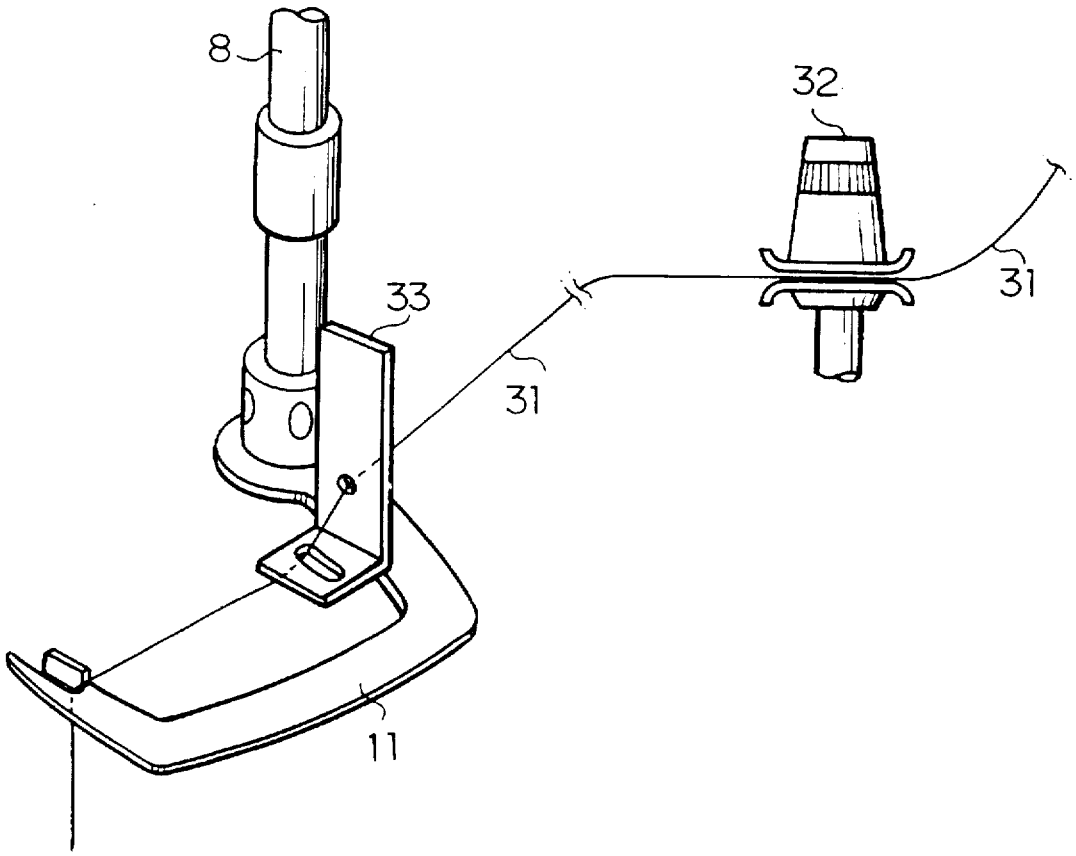
FIG. 2 is a perspective view outlining a thread path.

In this operation, as shown in FIG. 2, a thread path is provided; that is, the upper thread 31 pulled out of a thread supplying source is fed through a thread tension unit 32 to a thread control section (not shown), and then through a thread guide 33 to the spreader 11.

Referring back to FIG. 1, a substantially cylindrical drive force transmitting sleeve 12 forming an upper decoration switching mechanism is rotatably and slidably mounted on the substantially middle portion of the aforementioned spreader shaft 8. The drive force transmitting sleeve 12 is set inside a U-shaped bracket 13 which is secured to the machine frame in such a manner that the sleeve 12 is rotatably and not movable in the direction of the shaft.

A driven-side coupling pin 14 radially outwardly extends from the outer surface of the aforementioned drive force transmitting sleeve 12. The coupling pin 14 receives a swing drive force from an upper decoration drive mechanism (described below), to swing the aforementioned drive force transmitting sleeve 12.

That is, the drive force transmitting sleeve 12 and the spreader shaft 8 are swung by the upper decoration drive mechanism whose drive source is the spindle 1, so that the spreader 11 is swung in synchronization with the needle bar 2. The upper decoration drive mechanism uses a part of the above-described needle bar drive mechanism. More specifically, the needle bar drive crank 3 turned by the spindle 1 has a spreader drive arm 15 at a position spaced circumferentially slightly from the needle bar drive arm 5 in such a manner that the crank 3 radially outwardly extends from the crank. The spreader drive arm 15 is reciprocated in a substantially vertical plane. A drive-side coupling pin 16 is secured to the end portion of the spreader drive arm 15 in such a manner that it extends in the direction of axis of the spindle 1. The coupling pin 16 is coupled through a universal joint 17 to a driven-side coupling pin 16 on the side of the spreader shaft 8.

The universal joint 17 is made up of a rod-shaped member which extends substantially horizontally. The universal joint 17 has spherical pivot bearings 17*a* and 17*a* at both ends. The drive-side coupling pin 16 and the driven-side coupling pin 14 are coupled to the pivot bearings 17*a* and 17*a* of the universal join 17 in such a manner that they are rotatable and tiltable, so that the motion of reciprocation and swing, in a substantially vertical plane, of the spreader drive arm 15 is transmitted through the universal join 17, as the motion of reciprocation and swing in a substantially horizontal plane to the drive force transmitting sleeve 12 on the side of the spreader shaft 8.

Figure 3:
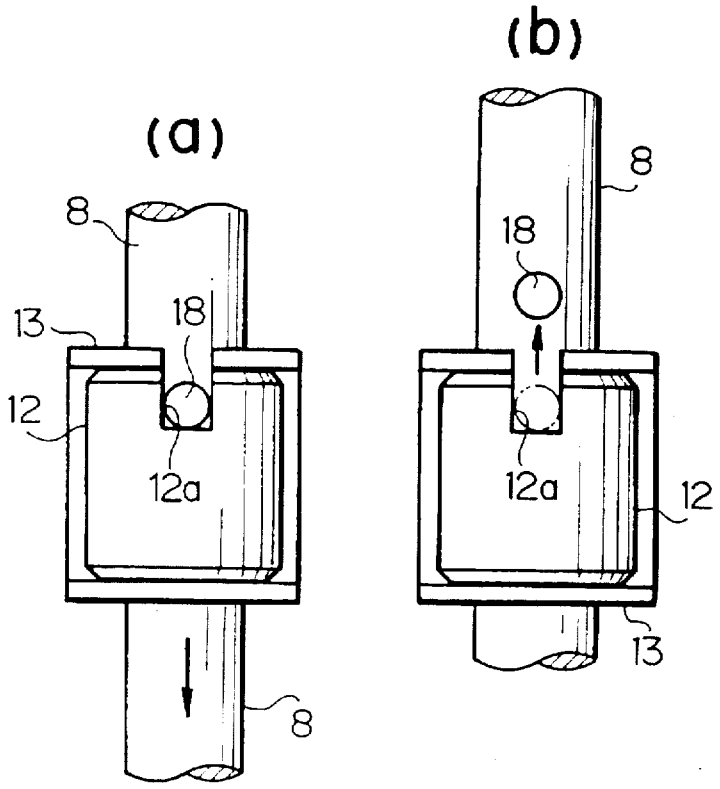
FIGS. 3(*a*) and 3(*b*) are explanatory diagrams showing an upper decoration switching mechanism, and a drive force transmitting sleeve forming an upper decoration drive mechanism.
Figure 4:
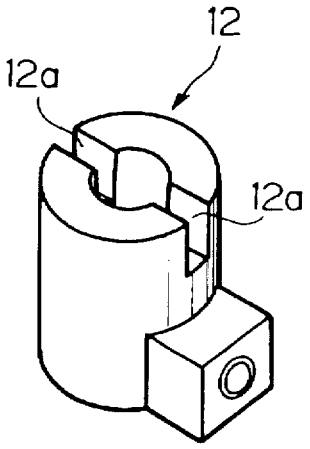
FIG. 4 is an enlarged perspective view of the drive force transmitting sleeve.

As shown in FIG. 3, too, an engaging pin 18 extends from the substantially middle portion of the spreader shaft 8 in correspondence to the above-described drive force transmitting sleeve 12. The engaging pin 18 penetrates the spreader shaft 8 in the direction of diameter, and protrudes from both sides of the spreader shaft 8 to a predetermined length. On the other hand, as shown in FIG. 4, too, the drive force transmitting sleeve 12 has locking grooves 12*a* and 12*a* in such a manner that the grooves 12*a* extend along the diameter of the sleeve 12. Those grooves 12*a* are adapted to receive both end portions of the engaging pin 18. In other words, the engaging pin 18 of the spreader shaft 8 is engaged with the locking grooves 12*a* of the drive force transmitting sleeve 12, so that motion of reciprocation and swing of the drive force transmitting sleeve is transmitted to the spreader shaft 8.

Referring again to FIG. 1, a compression coil spring 19 is mounted on the spreader shaft 8, and supported by a stationary bearing 9. The downward urging force of the compression coil spring 19 is applied to a spring receiving ring 21 secured to the spreader shaft 8, so that the spreader shaft 8 is kept pushed downwardly. Hence, the engaging pin 18 of the spreader shaft 8 is going to be inserted into the locking grooves 12*a* of the drive force transmitting sleeve by the downward urging force of the compression coil spring 19 (cf. FIG. 3(*a*)). On the other hand, in the case where the spreader shaft 8 is raised against the downward urging force of the compression coil spring 19, the engaging pin 18 is disengaged from the locking grooves of the drive force transmitting sleeve 12 (cf. FIG. 3(*b*)), as a result of which no drive force is transmitted to the spreader shaft 8.

As is apparent from the above description, the locking pin 18 of the spreader shaft 8, and the locking grooves 12*a* of the drive force transmitting sleeve 12 form an upper decoration switching mechanism which causes the upper decoration mechanism to engage with or disengaged from the spreader 11.

The upper decoration switching mechanism will be described.

Figure 5:
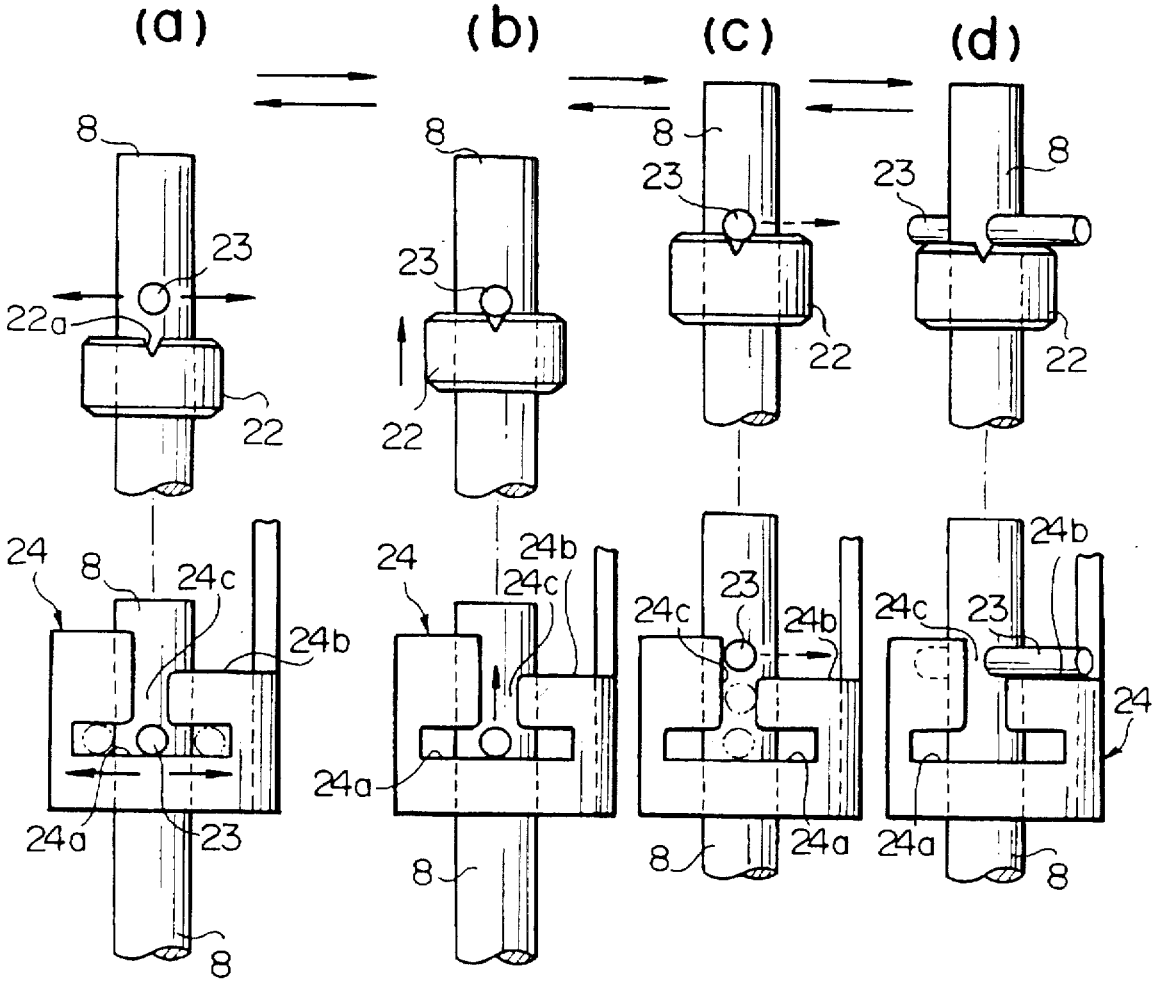
FIGS. 5(*a*) to 5(*d*), the upper parts thereof show the positional relationships between a release receiver and a release pin in the upper decoration switching operation; and the lower parts thereon show the positional relationships between the release pin and a release board in the same operation.

As shown in FIGS. 1 and 5(*a*) to 5(*d*), a substantially cylindrical release receiver 22 is axially slidably mounted on the upper end portion of the spreader shaft 8, and right above the release receiver, a release pin 23 is provided fixedly on the spread shaft 8. More specifically, the release pin 23 penetrates the spreader shaft 8, and protrudes from both sides of the spreader shaft 8 to a predetermined length. The release receiver 22 has V-grooves 22*a* in the upper surface to guide the release pin 23 to a predetermined position in such a manner that the V-grooves 22*a* extend along the diameter of the release receiver 22. As was described above, the spreader shaft 8 is kept pushed downwardly by the elastic force of the compression coil spring 19, so that the release pin 23 is pushed against the upper surface of the release receiver 22.

On the other hand, the release receiver 22 has a release board 24 half around it. The release board 24 is made up of a curved-board-shaped member. The release board 24 has two guide surfaces 24*a* and 24*b* to support the release pin 23 of the spreader shaft 28 at two different levels.

The guide surface 24*a* (hereinafter referred to as "a first guide surface 24*a*", when applicable) is lower than the guide surface 24*b* (hereinafter referred to as "a second guide surface 24*b*", when applicable). The first guide surface 24*a* lower than the second guide surface 24*b* is formed by cutting the release board 24 from the upper edge while forming a T-shaped cut, thus being extended arcuately to a predetermined length in a substantially horizontal plane. In the case where the release pin 23 is supported on the first guide surface 24*a* (cf. FIG. 5(*a*)), the whole spreader shaft 8 is held at the lower position, so that the engaging pin 18 are inserted into the locking grooves 12*a* of the drive force transmitting sleeve 12 (cf. FIG. 3(*a*)).

That is, in this case, the engaging pin 18 of the spreader shaft 8 is circumferentially engaged with the locking grooves 12*a* of the drive force transmitting sleeve 12. As a result, the spreader shaft 8 is reciprocated, to swing the spreader 11, so that upper decorative stitches are added to ordinary over-edge chain stitches from above. The arcuate length of the first guide surface 24*a* is determined slightly longer than the amount of swing of the engaging pin.

On the other hand, the second guide surface 24*b* higher in level than the first guide surface 24*a* forms the outer edge of the release board 24. The second guide surface 24*b* arcuately extends in a substantially horizontal plane above the first guide surface 24*a*. One end of the second guide surface 24*b* is continuous to a communicating groove 24*c* which extends downwardly therefrom. More specifically, the second guide surface 24*b* is continued through the communicating groove 24*c* to the substantially middle of the first guide surface 24*a*.

In the case where the release pin 23 is supported on the second guide surface 24*b* (cf. FIG. 5(*d*)), the spreader shaft 8 is held, in its entirety, at the upper position, so that the engaging pin 18 is removed upwardly from the locking groove 12*a* of the drive force transmitting sleeve 12 (cf. FIG. 3(*b*)). Hence, in this case, the spreader 11 is not swung, and ordinary over-edge chain stitching and ordinary low decorative stitching are performed.

As was described above, the first guide surface 24*a* is continued to the second guide surface 24*b* through the communicating groove 24c. With the upper decoration switching mechanism (described below), the aforementioned release receiver 22 is moved up and down, so that the release pin 23 is moved between the first and second guide surfaces 24a and 24b through the communicating groove 24c.

As illustrated in FIG. 1, the release receiver 22 is moved up and down by a release lever 25. More specifically, the release lever 25 is fixedly mounted on a release shaft 26. Release shaft 26 is rotatably supported on a bracket 27 which is fixedly mounted on the machine frame (not shown). The end portion of the release shaft 26 is coupled to the release receiver 22 through a pair of release links 28A and 28B which are coupled L-shaped to each other. Owing to the release links 28A and 28B, motion of swing of the release lever 25 is transmitted, as motion of reciprocation along the axis, to the release receiver 22.

When the release lever 25 is swung in a release direction in FIG. 1, the release receiver 22 is moved upwardly to lift the release pin 23, so that release pin 23 is set on the second guide surface 24b. On the other hand, when the release lever 25 is swung in a set direction in FIG. 1, the release receiver 22 is moved downwardly, so that, in the case where the release pin 23 is in the communicating groove 24c, the release pin 23 is set on the first guide surface 24a passing through the communicating groove 24c.

In the sewing machine to which the technical concept of the invention is applied, a mechanism (not shown) is provided which is adapted to switch the operation of an up-down looper depending on the kind of seam which has been disclosed by Japanese Patent Application Laid-open No. Hei. 6-262 or instead of the mechanism as disclosed by the Hei. 6-262, a mechanism (not shown) is provided in which an up-down looper and a multi-thread looper are provided separately which are each switched active and inactive.

In the lock sewing machine, the embodiment of the invention, by operating the release lever 25, the spreader 11 is switched active and inactive. This switching operation will be described in more detail.

First, it is assumed that, as shown in FIG. 5(*a*), during the operation of the sewing machine the release pin 23 of the spreader shaft 8 is supported on the first guide surface 14a of the release board 24. In this case, the locking pin 18 of the spreader shaft 8 is inserted in the locking groove 12a of the drive force transmitting sleeve 12; that is, the spreader shaft 8 is engaged with the locking groove 12a. Hence, as shown in FIG. 6(*a*), the spreader 11 is swung, upper decorative stitches are added to ordinary over-edge chain stitches and lower decorative stitches.

Next, the sewing machine is stopped, and as shown in FIG. 5(*b*) the release pin 23 of the spreader shaft 8 is positioned substantially at the center of the first guide surface 24a of the release board 24. Under this condition, the release lever 25 is swung in the release direction (FIG. 1). As a result, the release receiver 22 is lifted, and abutted against the release pin 23. Thereafter, as shown in FIG. 5(*c*), as the release receiver 22 is further lifted, the release pin 23 together with the spreader shaft 8 is moved upwardly through the communicating groove 24c. In this operation, as shown in FIG. 6(*b*), the spreader 11 is also moved upwardly.

Figure 6:
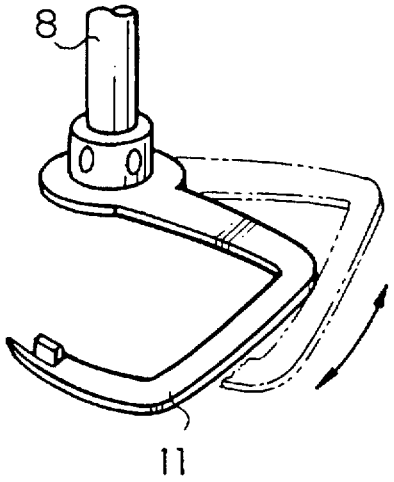
FIGS. 6(*a*) to 6(*c*) are perspective views for a description of the operation and positions of the spreader in the upper decoration switching operation.
Figure 6:
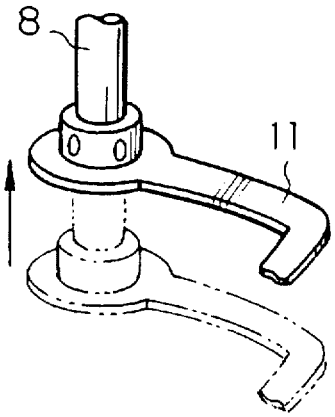
Figure 6:
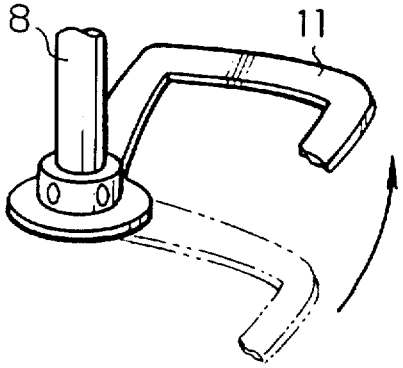

When the release pin 23 reaches the level of the second guide surface 24b of the release board 24, as shown in FIG. 6(*c*), the spreader 11 is swung to the standby position. As a result, as shown in FIG. 5(*d*) the release pin 23 is received by the second guide surface 24b of the release board 24. Therefore, the engaging pin 18 of the spreader shaft 8 is disengaged upwardly from the locking groove 12a of the drive force transmitting sleeve 12 (FIG. 1 and FIG. 3(*b*)). That is, the spreader 11 is maintained stopped, and only ordinary over-edge chain stitching and lower decorative stitching are performed.

With the over lock sewing machine, which is the embodiment of the invention, the spreader 11 adapted to perform upper decorative stitching is switched active and inactive by the operation of the upper decoration switching mechanism. That is, when the spreader 11 is made active by the operation of the release lever, the upper thread twisting operation performed from the upper surface adds upper decorative stitches to the conventional over-edge chain stitches and lower decorating stitches which are made from the lower surface of a fabric. On the other hand, when the release lever is swung in the opposite direction to make the spreader 11 inactive, then the spreader 11 is stopped, so that the conventional over-edge chain stitching and lower decorative stitching performed from the lower surface of the fabric are carried out safely and satisfactorily without interference with the spreader.

Figure 7:
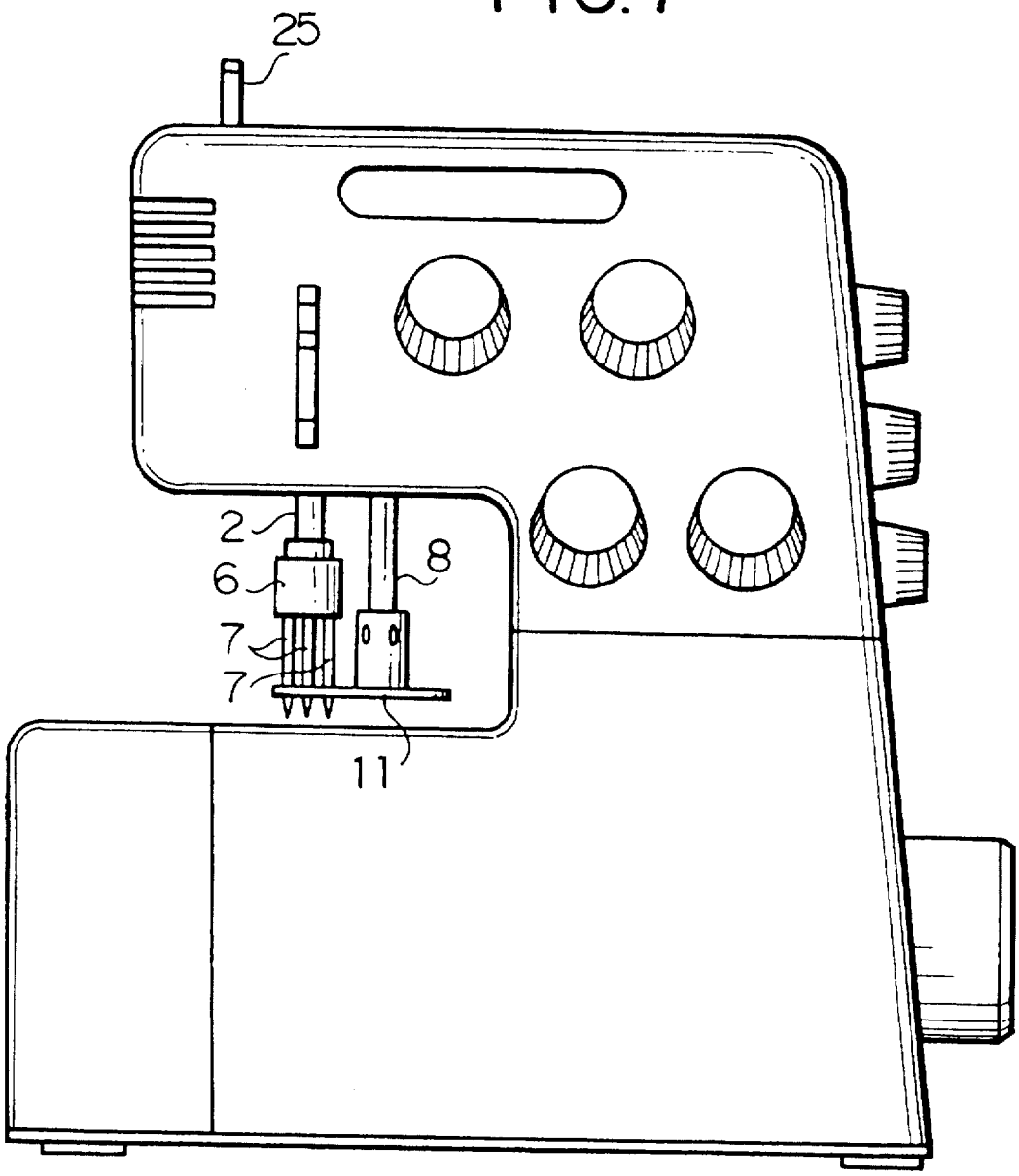
FIG. 7 is a front view of an over lock sewing machine, the embodiment of the invention.

The mechanism described above, and illustrated in FIGS. 1, 2, 3a, 3b, 4, 5a, 5b, 5c, 5d, 6a, 6b and 6c is installed in a sewing machine, as illustrated in FIG. 7. Release lever 25 serves to make spreader 11 on spreader shaft 8 active or inactive, while needle bar 2, is coupled to needle holder 6, which holds needles 7.

While there has been described in connection with the preferred embodiment of the invention, it will be obvious to those skilled in the art that various changes and modifications may be made therein without departing from the invention. For instance, in the above-described embodiment, the technical concept of the invention is applied to a lock sewing machine; however, the technical concept of the invention is applicable to a variety of sewing machines other than a lock sewing machine.

That is, the kind of a sewing machine to which the technical concept of the invention is applicable, is not limited as long as it is so designed that the spreader is switched active and inactive. For instance, the technical concept of the invention may be applied to a double-needle type sewing machine in which the needles and the shuttle cooperate with each other, in such a manner that upper decorating stitching is performed by twisting the upper decorative thread around the two lock stitch seams. The above-described mechanism may be applied to a sewing machine which is provided for multi-thread chain stitching only. In this case, the upper decorative thread is twisted around the two multi-thread chain stitch seams.

In the above-described embodiment, the drive source is the spindle 1; however, any drive source may be employed if it is synchronous with the spindle 1.

Furthermore, a switching/interlocking mechanism may be provided for the upper decoration switching mechanism and the looper, so that the spreader and the looper are selectively used. This feature further improves the reliability of the sewing machine.

As was described above, in the invention, the spreader adapted to perform upper decorating stitching is switched active or inactive by the upper decoration switching mechanism. By placing the spreader in active state, upper decorative stitches are added from above the fabric to conventional over-edge chain stitches and lower decorative stitches made from below the fabric. And by placing the spreader in inactive state; i.e., by stopping the spreader, over-edge chain stitching without upper decorating stitching, and lower decorative stitching are performed without interference with the spreader. Hence, with the lock sewing machine, upper decorative stitching can be achieved satisfactorily and safely. This feature greatly improves the lock sewing machine in usability and reliability.

What is claimed is:

1. A multi-thread chain stitch sewing machine in which at least a lower looper cooperates with sewing needles fixed to a needle bar to form multi-thread chain stitch seams, comprising:

a spreader having a spreader shaft about which the spreader reciprocates to move to and from the needle bar, for twisting an upper thread from the upper surface of a seam to add upper decorative stitches to an ordinary seam;

a drive mechanism which applies a drive force being synchronous with the needle bar, to the spreader; and a switching mechanism which connects the spreader to the drive mechanism and disconnects the spreader from the drive mechanism.

2. The multi-thread chain stitch sewing machine according to claim 1, wherein the switching mechanism comprises:

a lever operative between a first position and second position; and a link connecting to the lever and the spreader shaft wherein the link moves the spreader shaft in a vertical direction when the lever is in the first position in order for an engaging pin to be inserted into a locking groove, and the link moves the spreader shaft in the opposite direction when the lever is in the second position in order for the engaging pin to release from the locking groove.

3. An over-edge chain stitch sewing machine in which at least an upper looper is selectively placed in active state or in inactive state, so that an over-edge chain stitch seam which is formed with the upper looper and a lower looper, and a multi-thread chain stitch seam which is formed with the lower looper only are selectively formed, the over-edge chain stitch sewing machine comprising:

a spreader having a vertical axis about which the spreader reciprocates to move to and from the needle bar, for twisting an upper thread from the upper surface of a seam to add upper decorative stitches to an ordinary seam;

a drive mechanism which applies a drive force being synchronous with the needle bar, to the spreader; and a switching mechanism which connects the spreader to the drive mechanism and disconnects the spreader from the drive mechanism.

4. The over-edge chain stitching sewing machine according to claim 3, wherein the switching mechanism comprises:

a lever operative between a first position and second position; and a link connecting to the lever and the spreader shaft wherein the link moves the spreader shaft in a vertical direction when the lever is in the first position in order for an engaging pin to be inserted into a locking groove, and the link moves the spreader shaft in the opposite direction when the lever is in the second position in order for the engaging pin to release from the locking groove.

* * * * *